US011772950B2

(12) United States Patent
Scott et al.

(10) Patent No.: US 11,772,950 B2
(45) Date of Patent: Oct. 3, 2023

(54) LASER ALIGNMENT TOOL FOR CAPPING HEADS IN A CAPPING MACHINE

(71) Applicants: Mike Scott, Midland, MI (US); Michael Degraw, Shepherd, MI (US)

(72) Inventors: Mike Scott, Midland, MI (US); Michael Degraw, Shepherd, MI (US)

( * ) Notice: Subject to any disclaimer, the term of this patent is extended or adjusted under 35 U.S.C. 154(b) by 0 days.

(21) Appl. No.: 17/649,695

(22) Filed: Feb. 2, 2022

(65) Prior Publication Data

US 2023/0242390 A1 Aug. 3, 2023

(51) Int. Cl.
*B67B 3/26* (2006.01)

(52) U.S. Cl.
CPC ..... *B67B 3/264* (2013.01)

(58) Field of Classification Search
CPC ..... B67B 3/26; B67B 3/261; B67B 3/262; B67B 3/264; B67B 3/265
See application file for complete search history.

(56) References Cited

U.S. PATENT DOCUMENTS 9,417,145 B2 * 8/2016 Cochran ..... G01N 21/909
2002/0148205 A1 * 10/2002 Takebe ..... B67B 3/20 53/331.5
2007/0289935 A1 * 12/2007 Granger ..... B23K 26/364 53/488
2013/0014369 A1 * 1/2013 Schulthess ..... B23P 19/105 29/714
2015/0033667 A1 * 2/2015 Cirio ..... B67B 3/264 53/329
2015/0211958 A1 * 7/2015 Brueckmeier ..... G01M 3/3209 356/138
2015/0276341 A1 * 10/2015 Foster ..... F41A 33/02 434/21
2018/0172603 A1 * 6/2018 Piana ..... G01B 11/24
2020/0198953 A1 * 6/2020 Schafer ..... B67B 3/264

* cited by examiner

*Primary Examiner* — Anna K Kinsaul
*Assistant Examiner* — Himchan Song

(57) ABSTRACT

A laser alignment tool for capping heads. The laser alignment tool comprising in combination an adapter housing that is adaptable to a headset or spindle on a capping machine, a laser bore housing, a laser pointer contained in the laser bore housing and a laser center platform.

3 Claims, 1 Drawing Sheet

LASER ALIGNMENT TOOL FOR CAPPING HEADS IN A CAPPING MACHINE

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

The applicant is unaware of any prior art in this field.

BRIEF SUMMARY OF THE INVENTION

The present invention is a laser alignment tool for capping heads. The laser alignment tool comprises in combination an adapter housing that is threadably adaptable to a headset or spindle on a capping machine. There is a laser bore housing. The laser bore housing has a flat lower end. There is a laser pointer contained in the laser bore housing. The laser pointer has a lower end and there is mounted on the lower end, a dimple and a laser center platform.

Further contemplated within the scope of this invention is a laser alignment tool in combination in with a laser center platform mounted on the bottle retention knife.

Still further contemplated within the scope of this invention is a laser alignment tool wherein the laser center platform has a lower end, and the lower end contains a magnet.

BRIEF DESCRIPTION OF THE SEVERAL VIEWS OF THE DRAWING(S)

DETAILED DESCRIPTION OF THE INVENTION AND DRAWINGS

Figure 1A:
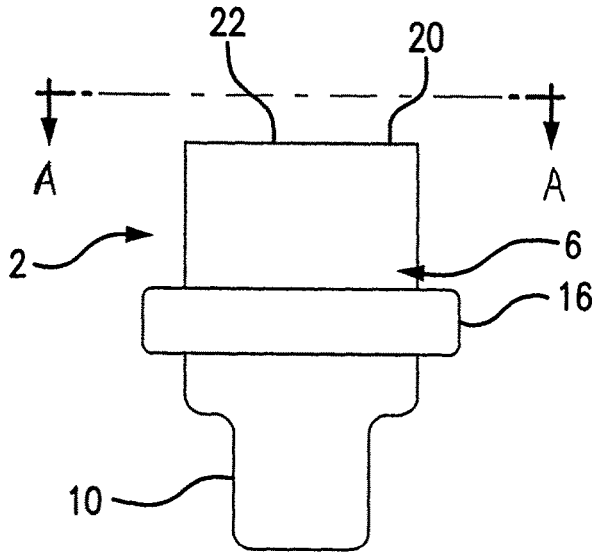
FIG. 1A shows a full side view of the laser alignment tool of this invention.

Turning to FIG. 1, FIG. 1 shows a full side view of the laser alignment tool 2. The laser alignment tool 2 comprises in combination, an adapter housing 6 that is adaptable to a headset or spindle on a capping machine (not shown and not part of the invention). There is a laser bore housing 10 and a laser pointer 12 contained in the laser bore housing 10, and a laser center platform 14 (FIG. 2). The near end 16 of the adapter has an inside surface that is threaded 18. The distal end 20 of the laser bore housing has an inside surface 22 that is threaded.

Figure 1B:
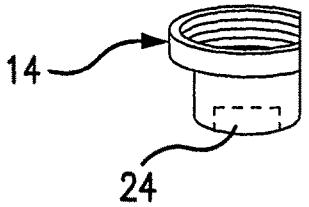
FIG. 1B shows a side view of a laser center platform.
Figure 2:
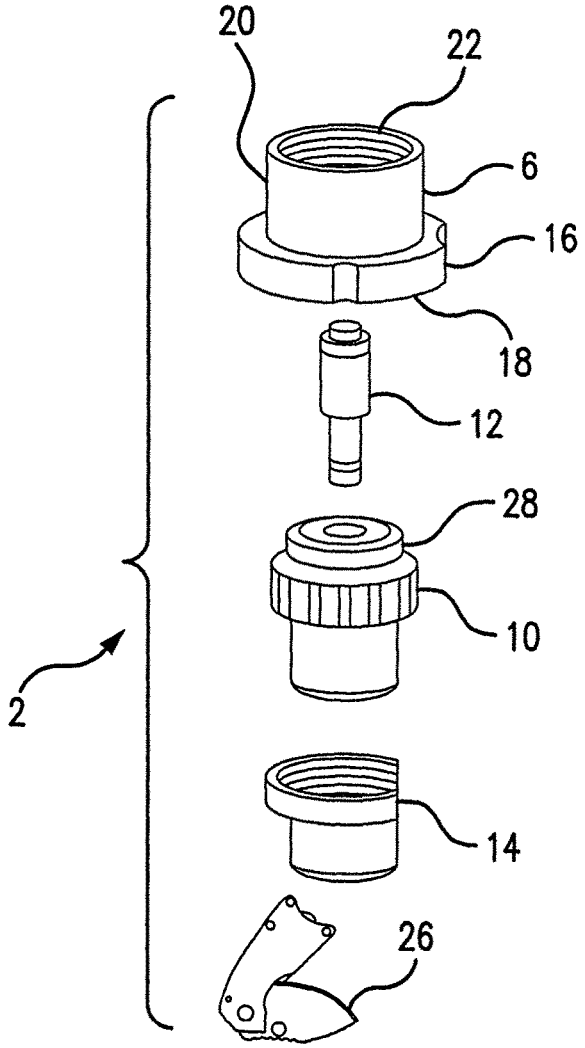
FIG. 2 shows an exploded view of the device of this invention.

FIG. 1B shows a side view of the laser centered platform 14. The laser centered platform 14 has a magnet 24 located therein.

FIG. 2 shows an exploded view of the device of this invention. The adapter 6 is designed to house the laser bore housing 10 and the laser pointer 12. The near end 16 of the adaptor has an inside surface that is threaded 18. The distal end 20 of the laser bore housing has an inside surface 22.

Also shown is the laser bore housing 10 and the laser pointer 12. The laser center platform 14 with the magnet 16 is also shown. The bottle retention knife 26 is also shown.

Figure 3:
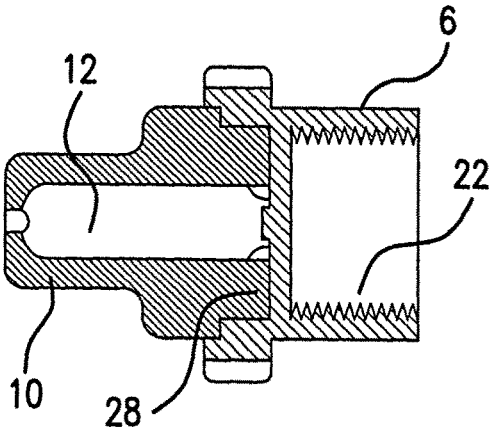
FIG. 3 shows a cross sectional view of the laser alignment tool of FIG. 1A through line A-A of FIG. 1A.

FIG. 3 shows the adaptor housing 6 from the side. The laser pointer 12 slides inside the laser bore 10 and the adapter screws on to the top 28 of the laser bore 10 securing the laser pointer 12 within the laser bore 10 and the adapter 6.

The laser alignment tool 2 is mounted on a bottle capping machine. The laser alignment tool 2 lets the operator keep the capping chuck within certain parameters to improve the efficiency of the bottle capping chuck and the bottle capping machine with regard to alignment of the capping machine with the bottle end.

What is claimed is:

1. A laser alignment tool for capping heads, said laser alignment tool comprising in combination:

i. an adapter housing that is threadably adaptable to a headset or spindle on a capping machine;

ii. a laser bore housing, said laser bore housing having a flat lower end;

iii. a laser pointer contained in said laser bore housing, said laser pointer having a lower end and, mounted on said lower end, a dimple, and iv. a laser center platform.

2. The laser alignment tool as claimed in claim 1 in combination with a laser center platform mounted on said a bottle retention knife.

3. The laser alignment tool as claimed in claim 1 wherein said laser center platform has a lower end and said lower end contains a magnet.

* * * * *